United States Patent [19]

Comeau

[11] Patent Number: 4,763,519

[45] Date of Patent: Aug. 16, 1988

[54] PRESSURE ACTUATOR SWITCH

[75] Inventor: Laurier J. (Larry) Comeau, Edmonton, Canada

[73] Assignee: NL Sperry-Sun of Canada, Ltd., Edmonton, Canada

[21] Appl. No.: 890,595

[22] Filed: Jul. 25, 1986

[30] Foreign Application Priority Data

Jul. 31, 1985 [CA] Canada ..... 487866

[51] Int. Cl.[4] ..... E21B 44/00

[52] U.S. Cl. ..... 73/151; 200/82 R

[58] Field of Search ..... 73/151, 155; 200/82 R, 200/82 C

[56] References Cited

U.S. PATENT DOCUMENTS

| | | | |
|---|---|---|---|
| 2,265,098 | 12/1941 | Bettis | 73/151 |
| 2,543,823 | 3/1951 | Barry | 200/82 R |
| 3,223,184 | 12/1965 | Jones et al. | 200/82 R |
| 3,275,769 | 9/1966 | Weaver | 200/82 R |
| 3,391,263 | 7/1968 | Young | 200/82 R |
| 3,441,093 | 4/1969 | Boop | 200/82 R |
| 3,860,068 | 1/1975 | Abney et al. | 166/120 |
| 3,896,667 | 7/1975 | Jeter | 73/151 |
| 3,908,453 | 9/1975 | Jeter | 73/151 |
| 4,266,613 | 5/1981 | Boop | 200/82 R X |

*Primary Examiner*—Stewart J. Levy
*Assistant Examiner*—Kevin D. O'Shea
*Attorney, Agent, or Firm*—Browning, Bushman, Zamecki & Anderson

[57] ABSTRACT

The invention comprises a pressure actuated switch which is actuated when the inlet port of the device is exposed to a preselected pressure. A piston size, and one or more shear pins, is selected for the desired operating pressure, the piston area being inversely proportional to the desired operating pressure. Shear pins are preferably of one size and material. When the desired operating pressure is applied, the force of the piston causes the shear pin to shear thereby allowing an electrical contact to complete an electrical circuit and initiate operation of a selected device such as a recorder, perforating gun, etc. If a single shear pin is used, with any selected piston and desired operating pressure, the shear force applied is a constant; i.e., for any given operating pressure and selected piston size with a single shear pin, the applied shear force is the same. If two shear pins are required, the applied shear force is doubled. This apparatus provides a switch which will operate over a wide pressure range (approximately 3,500–20,000 psi) with a high degree of accuracy and reliability.

9 Claims, 1 Drawing Sheet

PRESSURE ACTUATOR SWITCH

BACKGROUND OF THE INVENTION

1. Field of the Invention

The invention relates to apparatus for measuring formation pressure in a most informative and efficient manner and which is adaptable to be tubing conveyed. More particularly, the invention relates to formation pressure measurement apparatus which is tubing conveyed, therefore presenting substantially no pressure drop to the fluids flowing therethrough, and which provides a maximum of useful data with relatively little wasted data. Even more particularly, the present invention relates generally to apparatus for initiating the operation of pressure gauges which are used in measuring oil well formation or bottom hole pressures.

2. Description of the Background

Pressure is probably the most important directly measurable parameter of an oil reservoir. From pressure measurements many other important variables can be derived which can be used in evaluating a well or reservoir, such as method of production, effectiveness of secondary recovery processes, etc. Reservoir Engineers can determine effective permeability, porosity, effective drainage radius, extent of well bore damage (if such exists), continuity of aquifer, oil zone or gas cap from various pressure measurements. These provide transient pressure measurements under draw down, or build-up conditions and interference effects in a shut-in well due to a change in production or injection in another well.

In drill stem testing, special formation test equipment is mounted on the end of the drill string and lowered into the hole to a point above or adjacent to the horizon to be tested.

Drill stem tests are made to ascertain the potential productivity of a penetrated zone, to assess formation damage, to determine native reservoir pressures, and to obtain fluid samples (surface and/or subsurface). Such tests can also be used to confirm the effectiveness of water shutoffs and to determine the capability of perforations to admit fluids freely to the hole.

A drill stem test involves the measurement of bottom hole pressures with the formation to be tested alternatively closed-in and open to flow to the surface. Therefore, the equipment in the overall assembly consists of the pressure-recording device, the flow-control valves, one or more gland-type packers, and various other safety and control mechanisms. Surface equipment may also include pressure and flow measuring and control devices, along with necessary manifolds, tanks, separators, burners, etc. The test equipment or tool is made up on the drill string and set down on the bottom of the hole. A packer, an expandable hard-rubber sealing element, seals off the hole below it by expanding it with various setting techniques. A valve is opened, and any formation pressure and fluids present enter the tool. A recorder in the tool makes a recording of the formation pressure. Then the packer is released and the tool retrieved back to the surface. By looking at the record of the down hole pressure, a good indication of the characteristics of the reservoir can be obtained.

Applicant's present recording system provides delta time, probe temperature and pressure with accuracy and sensitivity for draw-down tests, build-up tests, interference tests, static tests, gradient tests, variable flow rate tests, and drill stem tests for example. These pressure records can be used to make a thorough analysis of any type of reservoir.

The recording system is battery powered, completely self-contained and records delta time, probe temperature and pressure for each record and stores it in memory. The recorder samples and records temperature and downhole pressure data for up to 60 days, depending on the batteries and sample rate selected.

The recording system can be programmed for a non-recording "delay time" of up to 17 hours to allow time for the probe to reach a desired depth before starting to collect data samples. After the delay time, the gauge can be programmed to shift to a "fast sample" mode (samples every 15 sec.) for up to 7 hours, after which it goes to the pre-selected sample interval (0.5 minutes to 64 minutes). Programming for the delay time, fast sample time and standard sample interval is done at the wellsite prior to putting the equipment downhole. This procedure is critical since the recorder capacity is only 2,000 samples.

Intelligent gauges (gauges which can be energized after a selected time interval) are extremely critical on production tests and on drill stem tests but many downhole problems occur while conducting drill stem tests. Intelligent gauges cannot be controlled after insertion into the borehole. The opportunity to activate a tool from surface, therefore, may have considerable advantages over even an intelligent gauge. For example, many cases have occurred where the drill string has been tripped in the well to one-half or three-quarters of intended depth when ice, bad weather, or rig servicing has required that operations be shut down for an extended period of time. If an intelligent gauge was programmed for a fixed delayed start with fast sample rate, and an extended delay occurred, very little recorder operating time (data samples) would be available for the critical part of this test. To compensate for this, four to eight minute sample modes are utilized to ensure complete test results, i.e. data samples during the entire test. However, this resolution will not adequately satisfy customer needs and a downhole tool with much greater memory (or the capability to activate at a desired time, i.e. upon reaching the test zone) to ensure high data rate over a given time period is needed. The present actuator switch is a direct result of this need and offers a pressure actuator switch capable of being triggered by applying a specific pressure to the tool after the target zone is reached. The pressure actuator switch of the present invention will effectively put the control of a drill stem test downhole data acquisition back on surface.

SUMMARY OF THE INVENTION

With the foregoing in view, the present invention provides an externally mounted tubing-conveyed pressure recording system for use in drill stem testing which allows full-bore flow through the entire length of the drill string. This is done by means of an electronic pressure recording system utilizing gauges, having a high degree of accuracy and sensitivity, communicating with the bore of the gauge carrier and which is preset to initiate recording upon a predetermined applied pressure. This allows an indefinite delay before starting a power drain on the batteries.

In another feature of the invention, an integral part of the magnetic recording pressure gauge is a shear pin-actuated switch which causes the recording equipment to begin operation at any desired bottom hole pressure and without damage to any equipment.

BRIEF DESCRIPTION OF THE DRAWINGS

Other features and intended advantages of the invention will be more readily apparent by the references to the following detailed description in connection with the accompanying drawings wherein.

While the invention will be described in connection with the preferred embodiment, it will be understood that it is not intended to limit the invention to that embodiment. On the contrary, it is intended to cover all alternatives, modifications and equivalents as may be included within the spirit of the invention as defined in the appended claims.

DESCRIPTION OF PREFERRED EMBODIMENTS

The purpose of the instant invention is to provide means for initiating (for example) operation of an electronic recording pressure gauge in a bore hole, for measuring variables such as temperature and pressure, at a predetermined bottomhole pressure. This allows optimum data collection from a preferred starting point related to pressure. The invention could also, for example, be used to fire perforating guns at any desired pressure.

Figure 1:
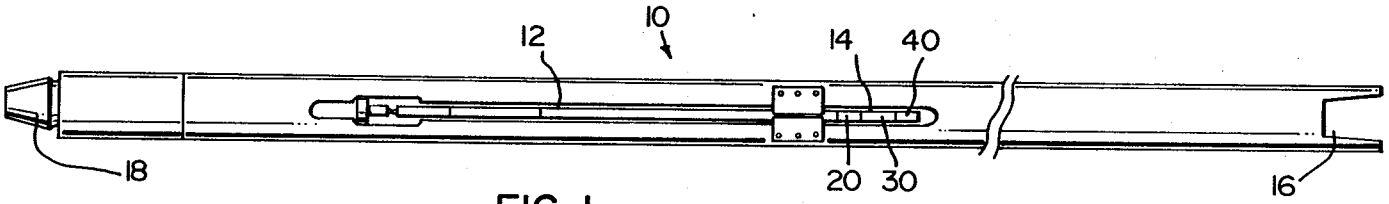
FIG. 1 is a front elevation view of a gauge carrier showing the gauge/recorder assembly and pressure actuator switch in place.

Referring now to FIG. 1, a gauge carrier adaptable to accommodate the present invention is generally shown at 10. A gauge and recorder system, to be activated by the present invention, is shown at 12. Finally the present invention, a pressure actuator switch (shown in detail in FIG. 2), is shown at 14. The end of the gauge and recorder system 12 which is in contact with the switch 14, houses a bank of batteries (not shown) which provide power to the recorder 12 or other device to be activated. The gauge carrier 10 may be incorporated into an ordinary drill string by means of the box 16 and pin 18.

Figure 2:
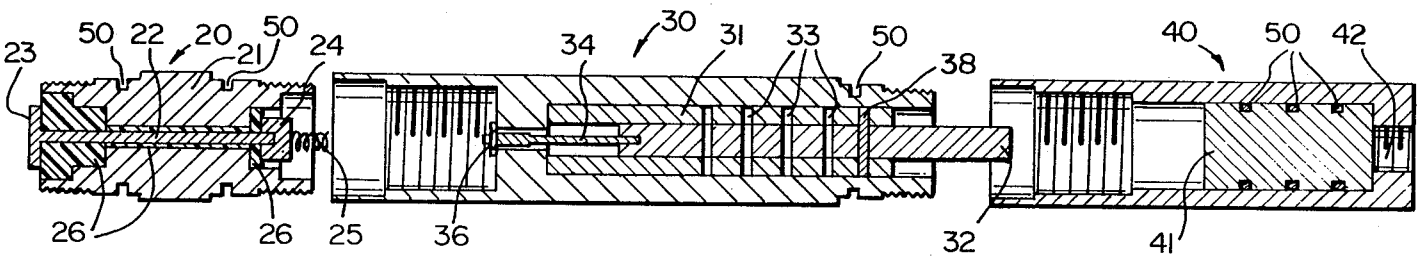
FIG. 2 is a sectional view of the top plug assembly, the outer housing assembly and the piston housing assembly.

The pressure actuator switch 14 of the present invention comprises three main interconnecting bodies. As shown in FIG. 2, these are the top plug assembly shown generally as 20, the outer housing assembly, shown generally as 30, and the piston housing assembly shown generally as 40.

Referring now to FIG. 2, the top plug assembly 20 comprises a housing 21 through which an electrical contact pin 22 is placed. The contact pin 22 is terminated at one end by a battery end plate 23 which provides a "seat" or electrical contact for the battery pack previously mentioned. The other end of the contact pin 22 is terminated with threads (not shown) which allows it to be screwed into the block plate 24. The block plate 24 is terminated by a metallic spring 25 which may be silver soldered (for example) onto the block plate 24, thereby completing the electrical circuit from the battery end plate 23 to the spring 25. The contact pin 22 is electrically insulated throughout its length from the housing 21 by suitable insulators 26.

Referring further to FIG. 2 the outer housing assembly is shown generally at 30 and houses the shear pin assembly comprising a plunger 32, a plunger housing 31, and a pin 34. The pin 34 is threaded at both ends so that it may be screwed into the plunger 32 and may be physically and electrically secured at its opposite end by a suitable nut 36. The plunger 32 and plunger housing 31 have multiple shear pin holes 33 drilled therethrough in alignment such that one or more shear pins 38 (for example) may be inserted for mechanically securing the two members 31, 32 together. Thus, when assembled as shown in FIG. 2, the entire outer housing assembly 30 is always at the same electrical potential, i.e., there is no insulator between any of the members or parts thereof. When the top plug assembly 20 and the outer housing assembly 30 are screwed together, thereby providing an electrically conductive path therebetween, the spring 25 and the nut 36 do not make electrical contact, i.e., do not provide an electrical ground to complete the circuit and thereby provide electrical power to the recorder 12. When pressure is applied such that the shear pin 38 is sheared (to be described below), the plunger 32 and the pin 34 will move toward the spring 25 thereby completing the electrical circuit and providing power to the recorder 12 or other suitable device.

Referring again to FIG. 2C, the piston housing assembly is shown generally at 40 and a suitable piston 41 is located therein. One entire face of the piston 41 is exposed, through opening 42, and because of tolerances within this assembly to the pressure surrounding the gauge carrier 10. With the piston housing assembly 40 screwed onto the outer housing assembly 30 for placement into the gauge carrier 10, the piston 41 may or may not be in physical contact with the plunger 32. At the predetermined pressure, the proper selection of piston size, i.e. the area of the face of the piston 41, will cause the shear pin 38 to shear, thus allowing the plunger 32 (with its pin 34) to move toward the spring 25, make contact therewith and complete the electrical ground for the battery pack. Suitable grooves 50 are situation in the switch 14 to allow for placement of various O-rings for sealing the various components and preventing contaminating atmospheres from entering therein.

Thus, the pressure actuator switch operates on the principle that by reducing the diameter of the piston exposed to the applied pressure, the shear force transmitted to the firing pin mechanism is essentially a constant multiplied by the number of shear pins required. The switch simply provides (upon actuation) an electrical ground to the recorder system (or other device which requires actuation) thereby enabling the start of its operation.

Table I shows the piston number and its corresponding face area:

TABLE I

| Cylinder & Piston Number | Square In. |
|---|---|
| 1 | 1.00000 |
| 2 | .93948 |
| 3 | .88664 |
| 4 | .83525 |
| 5 | .78540 |
| 6 | .73708 |
| 7 | .69029 |
| 8 | .64504 |
| 9 | .60132 |
| 10 | .55914 |
| 11 | .51849 |
| 12 | .47937 |
| 13 | .44179 |
| 14 | .40574 |
| 15 | .37122 |
| 16 | .33824 |
| 17 | .30680 |

Table II shows piston selection and the number of shear pins required for design firing pressures ranging from 3,483 psi to 20,158 psi.

TABLE II

| Design Firing Pressure | Piston Number | Pins |
|---|---|---|
| 3483 | 1 | 1 |
| 3708 | 2 | 1 |
| 3929 | 3 | 1 |
| 4171 | 4 | 1 |
| 4435 | 5 | 1 |
| 4726 | 6 | 1 |
| 5047 | 7 | 1 |
| 5401 | 8 | 1 |
| 5793 | 9 | 1 |
| 6230 | 10 | 1 |
| 6719 | 11 | 1 |
| 7009 | 1 | 2 |
| 7267 | 12 | 1 |
| 7416 | 2 | 2 |
| 7858 | 3 | 2 |
| 7885 | 13 | 1 |
| 8342 | 4 | 2 |
| 8586 | 14 | 1 |
| 8871 | 5 | 2 |
| 9384 | 15 | 1 |
| 9453 | 6 | 2 |
| 10094 | 7 | 2 |
| 10300 | 16 | 1 |
| 10514 | 1 | 3 |
| 10802 | 8 | 2 |
| 11124 | 2 | 3 |
| 11355 | 17 | 1 |
| 11587 | 9 | 2 |
| 11788 | 3 | 3 |
| 12461 | 10 | 2 |
| 12513 | 4 | 3 |
| 13307 | 5 | 3 |
| 13438 | 11 | 2 |
| 14019 | 1 | 4 |
| 14179 | 6 | 3 |
| 14535 | 12 | 2 |
| 14832 | 2 | 4 |
| 15141 | 7 | 3 |
| 15717 | 3 | 4 |
| 15771 | 13 | 2 |
| 16203 | 8 | 3 |
| 16684 | 4 | 4 |
| 17173 | 14 | 2 |
| 17381 | 9 | 3 |
| 17524 | 1 | 5 |
| 17743 | 5 | 4 |
| 18540 | 2 | 5 |
| 18692 | 10 | 3 |
| 18769 | 15 | 2 |
| 18906 | 6 | 4 |
| 19646 | 3 | 5 |
| 20158 | 11 | 3 |

The system is set for operation by first determining the hydrostatic pressure at the desired depth of operation. This pressure is simply the weight of the mud column and is determined by readily known mathematical formulae. With the known hydrostatic pressure, a piston assembly, including shear pin, can be selected which will activate the firing pin at a pressure slightly higher than hydrostatic. The desired recorder sample rate is selected and the entire assembly is lowered into the hole. Upon reaching the desired depth, a suitable packer is put in place and, when recording is desired (or operation of another particular device) annulus pressure is increased to a point where the switch is activated thereby completing the electrical circuit for the recorder or other such device.

What is claimed is:

1. An apparatus for use in activating a down hole device at a pre-selected pressure comprising:

a housing;

an inlet port in said housing for communicating any pressure at said port to the interior of said housing;

piston means in said housing communicating with said port for receiving any pressure which may be present in said port;

plunger means in said housing connected to said piston means for receiving forces exerted by said piston means;

at least one shear pin transversely situated in said plunger means for physically securing said plunger means within said housing until said pre-selected pressure has been exceeded; and contact means spaced from said plunger means, said contact means being electrically insulated from said housing means when said plunger means is held in place by said shear pin, and being electrically connected with said housing when said shear pin is caused to be sheared by said preselected pressure being exerted on said piston.

2. The apparatus of claim 1 wherein said at least one shear pin and the area of said piston are pre-selected to cause said shear pin to shear at said preselected pressure.

3. The apparatus of claim 1 wherein the shear force required to activate the piston means is a constant multiplied by the number of shear pins in the apparatus.

4. The apparatus of claim 1 wherein said at least one shear pin comprises a plurality of shear pins and the number of said shear pins required does not exceed 5 for the pre-selected pressure range from 3,500 psi to 20,000 psi.

5. The apparatus of claim 4 wherein said shear pins are all the same size.

6. The apparatus of claim 4 wherein said shear pins are made from the same material.

7. The apparatus of claim 1 wherein the apparatus is reusable except for the shear pin.

8. The apparatus of claim 1 wherein the said pre-selected pressure is reached by applying pressure from surface equipment.

9. The apparatus of claim 1 wherein said down hole device is a recorder.

* * * * *